US008459281B2

(12) United States Patent
Chen

(10) Patent No.: US 8,459,281 B2
(45) Date of Patent: Jun. 11, 2013

(54) RUNNER FASTENING DEVICE FOR AN UMBRELLA

(76) Inventor: Hsia-Hui Chen, Hsinchu County (TW)

( * ) Notice: Subject to any disclaimer, the term of this patent is extended or adjusted under 35 U.S.C. 154(b) by 40 days.

(21) Appl. No.: 13/111,303

(22) Filed: May 19, 2011

(65) Prior Publication Data

US 2012/0174953 A1 Jul. 12, 2012

(30) Foreign Application Priority Data

Jan. 6, 2011 (CN) ..... 2011 1 10001673

(51) Int. Cl.
*A45B 25/08* (2006.01)

(52) U.S. Cl.
USPC ..... 135/38; 135/28; 135/39

(58) Field of Classification Search
USPC ..... 135/28, 37–41
See application file for complete search history.

(56) References Cited

U.S. PATENT DOCUMENTS

| | | | | |
|---|---|---|---|---|
| 678,868 | A | 7/1901 | Gleason | |
| 2,740,417 | A * | 4/1956 | Klein | 135/41 |
| 3,856,032 | A * | 12/1974 | Schafer | 135/28 |
| 5,494,064 | A * | 2/1996 | Lee | 135/28 |
| 5,588,455 | A * | 12/1996 | Kuo | 135/28 |
| 5,615,698 | A * | 4/1997 | Ko | 135/28 |
| 6,006,771 | A * | 12/1999 | Wu | 135/41 |
| 6,371,141 | B1 * | 4/2002 | Lin et al. | 135/28 |
| 6,382,222 | B1 * | 5/2002 | Ko | 135/41 |
| 6,571,813 | B2 * | 6/2003 | Lin et al. | 135/28 |
| 7,806,130 | B2 * | 10/2010 | Gobel | 135/28 |
| 2003/0019513 | A1 | 1/2003 | Lin et al. | 135/28 |
| 2006/0081278 | A1 | 4/2006 | Lin et al. | 135/28 |
| 2007/0251558 | A1 * | 11/2007 | Ko | 135/41 |

FOREIGN PATENT DOCUMENTS

| | | | |
|---|---|---|---|
| FR | 2672781 | A3 * | 8/1992 |
| JP | 2010051607 | A * | 3/2010 |

* cited by examiner

*Primary Examiner* — Winnie Yip
(74) *Attorney, Agent, or Firm* — Fitzpatrick, Cella, Harper & Scinto

(57) ABSTRACT

A runner fastening device is provided for holding a runner of an umbrella at an upper position relative to a central shaft unit, and includes a spring catch having a retaining region and an actuated region, a retained member moved with the runner and having a retained slot which extends to terminate at an abutment wall to abut against the retaining region at the upper position, and a sleeve member movably surrounding the retained member. By mating engagement between cammed and camming surfaces of the retained member and the sleeve member, when the sleeve member is moved downwardly, the actuated region is pressed against a biasing action to retreat inwardly to sweep the retaining region away from the abutment wall to thereby permit downward movement of the runner.

5 Claims, 9 Drawing Sheets

RUNNER FASTENING DEVICE FOR AN UMBRELLA

CROSS-REFERENCE TO RELATED APPLICATION

This application claims priority of Chinese Patent Application No. 201110001673.5, filed on Jan. 6, 2011, the disclosure of which is herein incorporated by reference.

BACKGROUND OF THE INVENTION

1. Field of the Invention

This invention relates to an umbrella, more particularly to a runner fastening device operable to move a runner between engaging and disengaging positions.

2. Description of the Related Art

A conventional umbrella generally includes a runner disposed to be slidable on a central shaft to spread and collapse a rib-and-stretcher assembly on which a canopy is fastened, and a spring catch disposed in the central shaft adjacent to a topnotch such that the runner is moved over the spring catch and is retained by the spring catch so as to hold the umbrella in an opened state. However, when it is desired to close the umbrella, the user has to press an end of the spring catch with his/her finger for downward movement of the runner, and thus to render his/her finger prone to injury. Besides, it is uncomfortable to press the pointed and rigid-tipped surface of the spring catch.

SUMMARY OF THE INVENTION

An object of the present invention is to provide a runner fastening device which can be operated safely and comfortably to spread and collapse a canopy.

According to this invention, the runner fastening device includes an upper spring catch, a retained member, and a sleeve member. The upper spring catch has a mount end adapted to be mounted in a central shaft unit of an umbrella, and a catch end biased radially and outwardly of the central shaft unit. The catch end has an upper retaining region confronting upwardly, and an upper actuated region which extends outwardly and radially from the upper retaining region, and which has an upper cammed surface. The retained member is adapted to move with a runner between upper and lower positions for spreading and collapsing a rib-and-stretched assembly. The retained member has a tubular retained wall surrounding the central shaft unit, and having a retained slot which extends axially to terminate at an upper abutment wall that is brought to abut against the upper retaining region so as to hold the runner at the upper position. The sleeve member has an inner sleeve wall which surrounds and is axially movable relative to the tubular retained wall, and which has an upper camming surface configured to mate with the upper cammed surface. When the sleeve member is moved axially away from the upper position, the upper actuated region is pressed to retreat inwardly and radially so as to sweep the upper retaining region away from abutment with the upper abutment wall, thereby permitting the upper abutment wall to move away from the upper position by sliding over the upper cammed surface.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
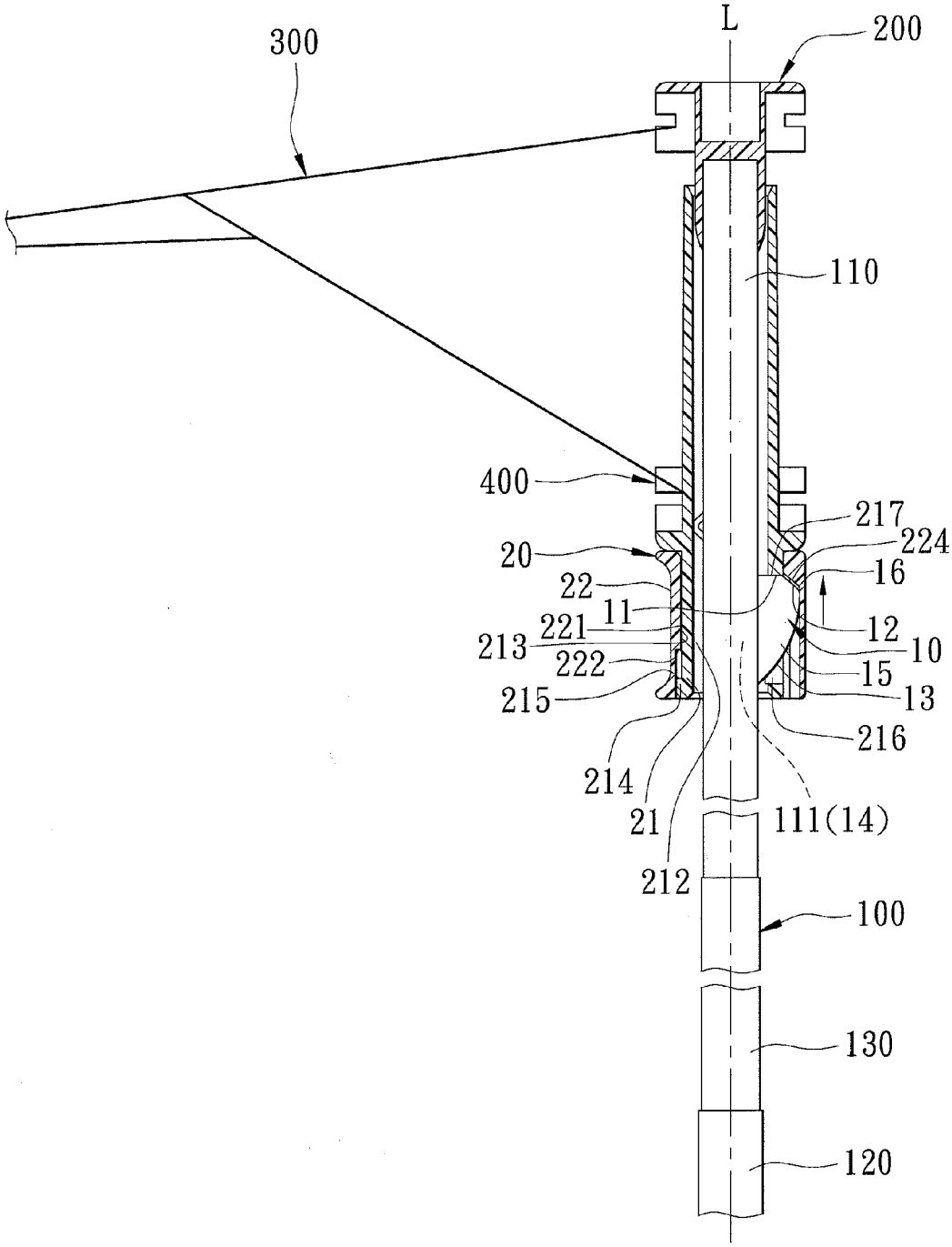
FIG. 1 is a fragmentary sectional view of the first preferred embodiment of a runner fastening device for an umbrella according to this invention in an opened state.

Before the present invention is described in greater detail, it should be noted that same reference numerals have been used to denote like elements throughout the specification.

Referring to FIG. 1, the first preferred embodiment of a runner fastening device according to the present invention is used with a foldable umbrella which includes a central shaft unit 100 having an upper shaft 110, a middle shaft 130, and a lower shaft 120 telescopically fitted to one another along an axis (L), a rib-and-stretcher assembly 300 pivotally connected to a top-side end 200 of the upper shaft 110 for mounting a canopy (not shown) thereon, and a runner 400 pivotally connected to the rib-and-stretcher assembly 300 and sleeved on and movable relative to the central shaft unit 100 between upper and lower positions for spreading and collapsing the canopy. The upper shaft 110 has an upper slot 111 formed proximate to the top-side end 200.

The runner fastening device of this embodiment is shown to comprise an upper spring catch 10 and an operating unit 20.

The upper spring catch 10 has a mount end 14 adapted to be mounted in the upper slot 111, and a catch end 15 which extends outwardly of the upper slot 111, and which is biased radially and outwardly. The catch end 15 is configured to have an upper retaining region 11 confronting upwardly and in a direction of axis (L), and an upper actuated region 16 which extends outwardly and radially from the upper retaining region 11, and which has an upper cammed surface. The upper cammed surface includes a first cammed segment 12 inclined outwardly and downwardly from the upper retaining region 11, and a second cammed segment 13 inclined inwardly and downwardly from the first cammed segment 12.

The operating unit 20 includes a retained member 21 and a sleeve member 22.

The retained member 21 is adapted to extend from, and to be integrally formed with the runner 400 so as to move with the runner 400 along the axis (L) between the upper and lower positions. The retained member 21 has a tubular retained wall 213 that extends along the axis (L) to define an axial space 212, and that is configured to surround the central shaft unit 100. The tubular retained wall 213 has a retained slot 216 which extends radially to communicate the axial space 212, and which extends axially to terminate at an upper abutment wall 217 that is brought to abut against the upper retaining region 11 of the upper spring catch 10 so as to hold the runner 400 at the upper position, as shown in FIG. 1. Further, the retained member 21 has a flange 214 extending radially and outwardly from a lower end of the tubular retained wall 213 to cooperatively define a shoulder 215 facing upwardly.

The sleeve member 22 has an inner sleeve wall 221 which extends along the axis (L) and which is sleeved on and slidably movable relative to the tubular retained wall 213 in the direction of the axis (L). The inner sleeve wall 221 has an upper camming surface 224 configured to mate with the upper cammed surface, and extends downwardly to terminate at an abutting surface 222 that axially confronts the shoulder 215.

Figure 2:
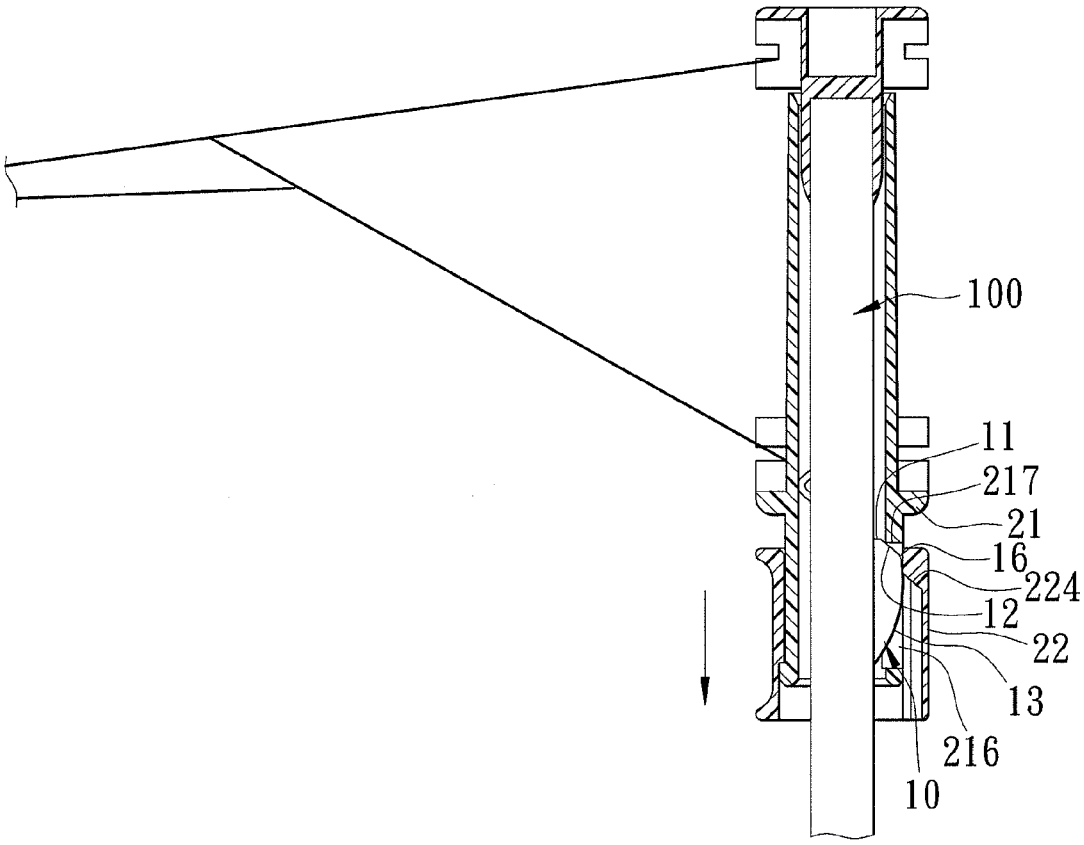
FIG. 2 is a fragmentary sectional view of the first preferred embodiment when a sleeve member is moved away from an upper position for closing the umbrella.
Figure 3:
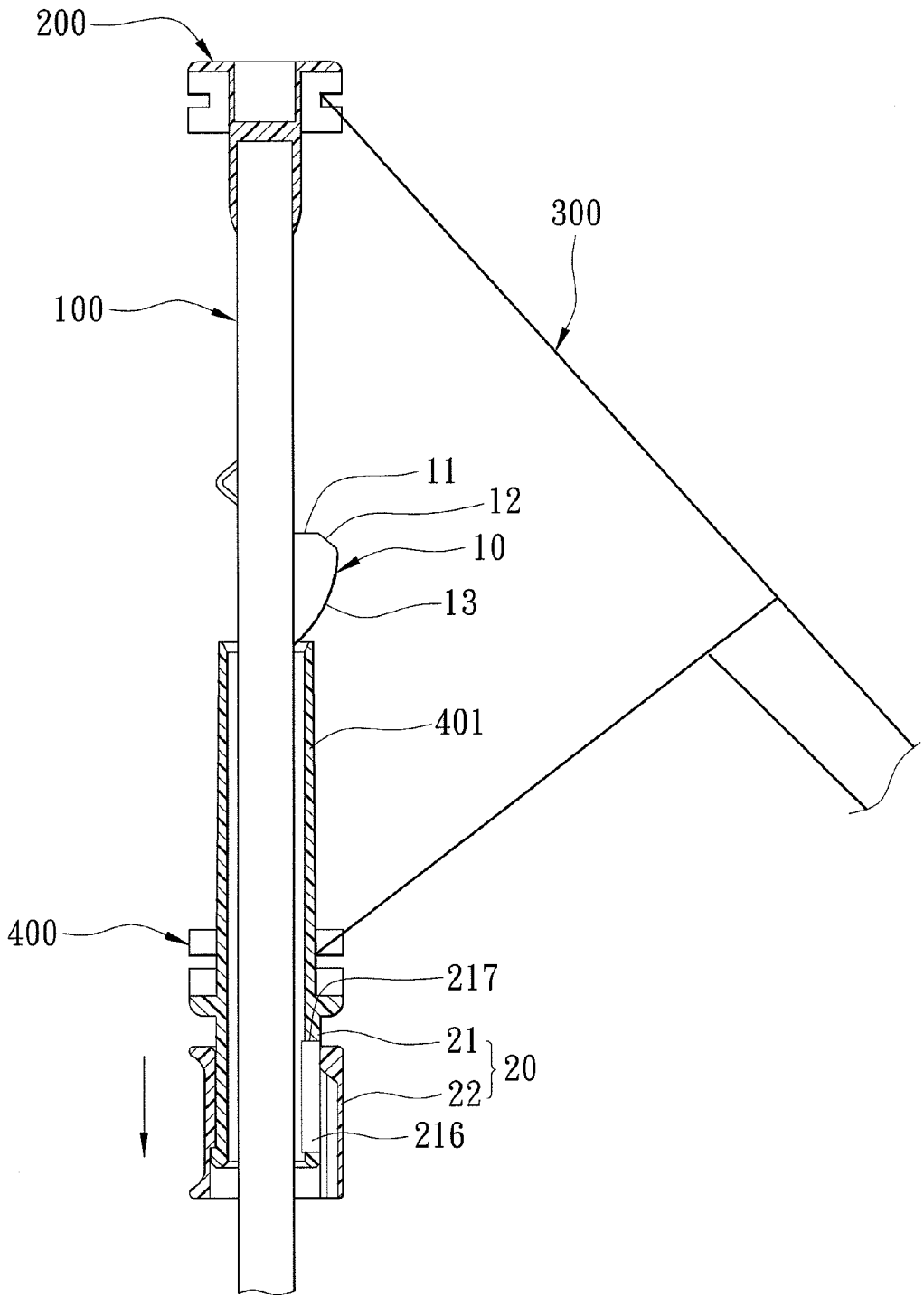
FIG. 3 is a fragmentary sectional view of the first preferred embodiment illustrating a downward movement of the sleeve member toward a closed state.

As shown in FIGS. 2 and 3, when it is desired to collapse the rib-and-stretcher assembly 300, the sleeve member 22 is forced manually to move axially away from the upper position. The upper actuated region 16 is pressed by the upper camming surface 224 against a biasing action to retreat inwardly and radially so as to sweep the upper retaining region 11 away from abutment with the upper abutment wall 217, thereby permitting the upper abutment wall 217 to move away from the upper position by sliding over the upper cammed surface. Thereafter, the abutting surface 222 abuts against the shoulder 215 to thereby facilitating movement of the retained member 21 toward the lower position while preventing the sleeve member 22 from falling off from the retained member 21.

When it is desired to open the umbrella, by mating engagement between an upper extension 401 of the runner 400 and the second cammed segment 13 of the upper spring catch 10, the upper spring catch 10 can be forced against the biasing action to retreat radially and inwardly so as to permit the movement of the operating unit 20 over the upper spring catch 10 until the catch end 15 is retained in the retained slot 216, as shown in FIG. 1.

Accordingly, the runner fastening device of the present invention is operated safely and conveniently without running any risk of injury to the user during operation.

Figure 4:
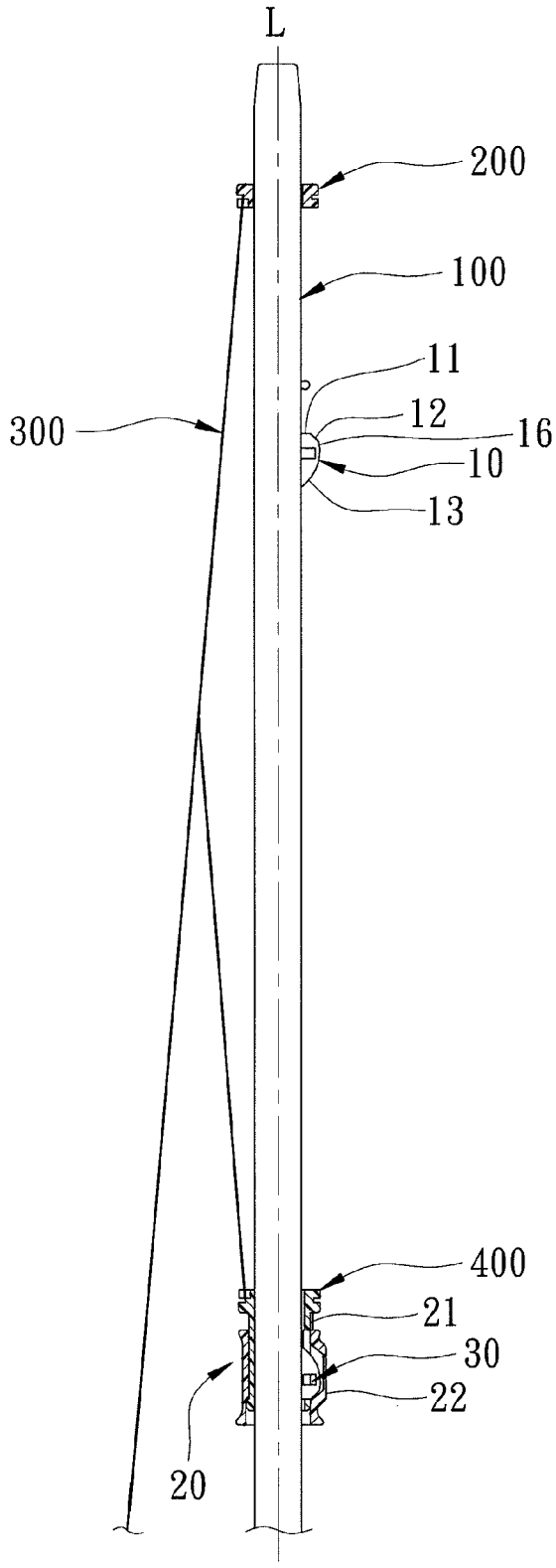
FIG. 4 is a fragmentary sectional view of the second preferred embodiment of a runner fastening device for an umbrella according to this invention in a closed state.
Figure 5:
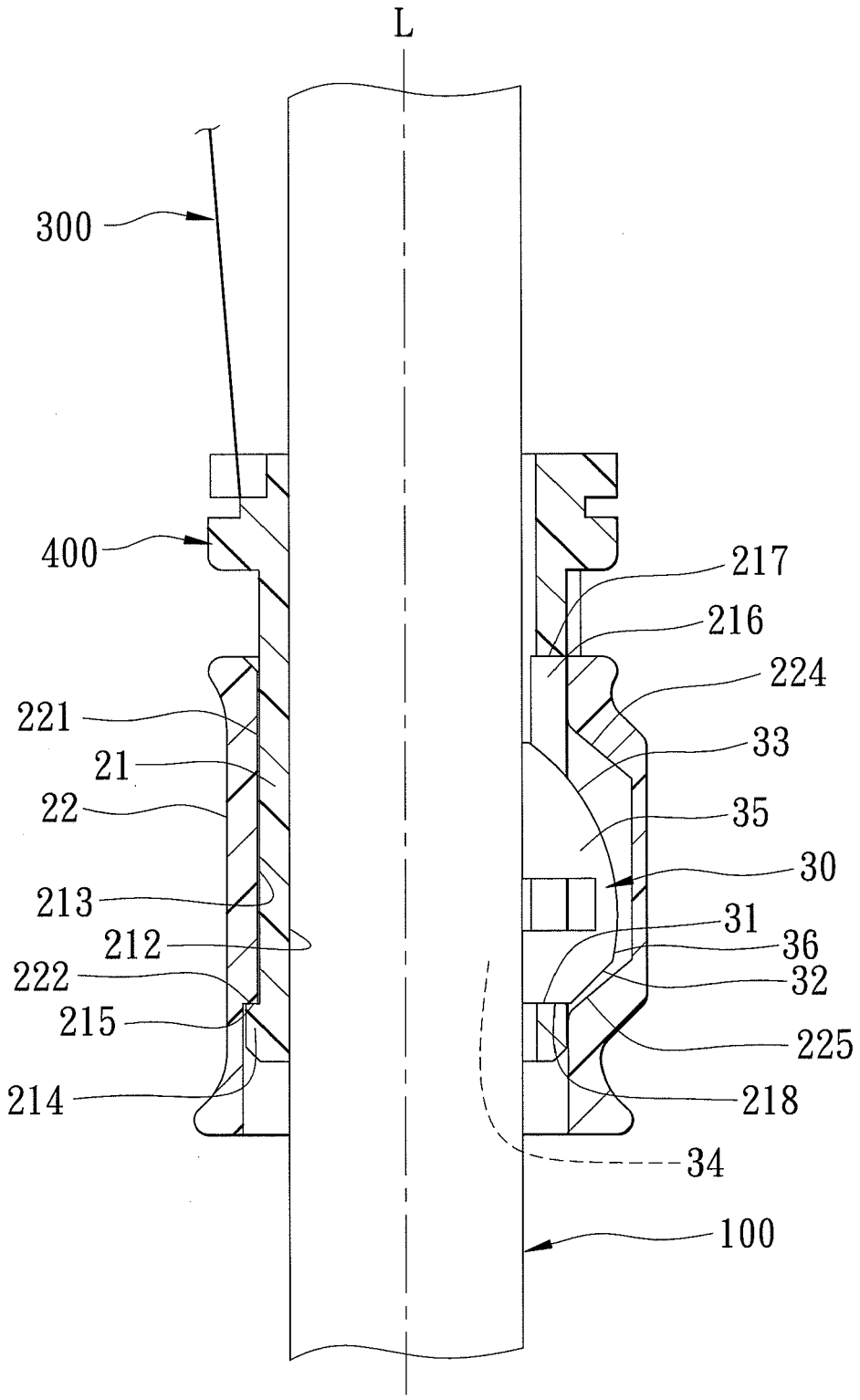
FIG. 5 is an enlarged sectional view of the second preferred embodiment.

Referring to FIGS. 4 and 5, the second preferred embodiment of the runner fastening device according to this invention is shown to be used with an umbrella with a central shaft unit 100 in the form of one-single shaft piece. In the second embodiment, the runner fastening device further comprises a lower spring catch 30 which has a mount end 34 adapted to be mounted in the central shaft unit 100 adjacent to a bottom-side end thereof, and a catch end 35 extending outwardly of the central shaft unit 100 and biased radially and outwardly. The catch end 35 is configured to have a lower retaining region 31 which confronts downwardly and in the direction of axis (L), and a lower actuated region 36 which extends outwardly and radially from the lower retaining region 31, and which has a lower cammed surface. The lower cammed surface includes a first cammed segment 32 inclined outwardly and upwardly from the lower retaining region 31, and a second cammed segment 33 inclined inwardly and upwardly from the second cammed segment 32.

Further, the retained slot 216 of the tubular retained wall 213 further extending axially to terminate at a lower abutment wall 218 which axially confronts the upper abutment wall 217, and which is brought to abut against the lower retaining region 31 so as to hold the runner at the lower position, as shown in FIGS. 4 and 5. Furthermore, the inner sleeve wall 221 of the sleeve member 22 has a lower camming surface 225 configured to mate with the lower cammed surface.

Figure 6:
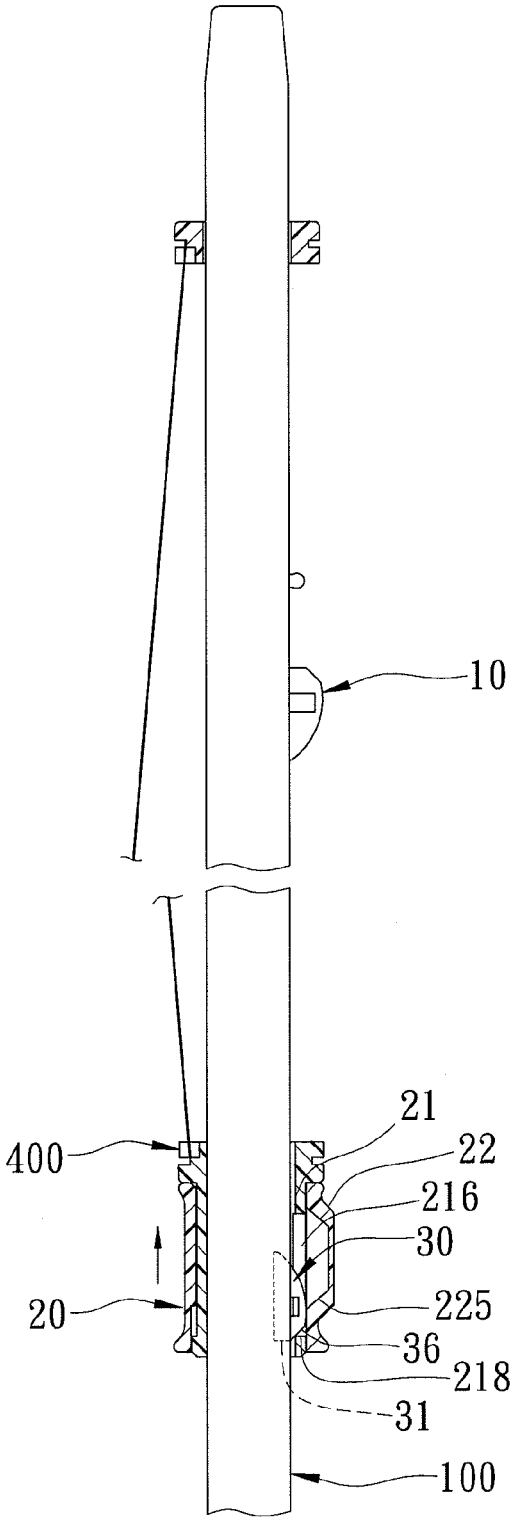
FIG. 6 is a fragmentary sectional view of the second preferred embodiment when a sleeve member is moved away from a lower position.
Figure 7:
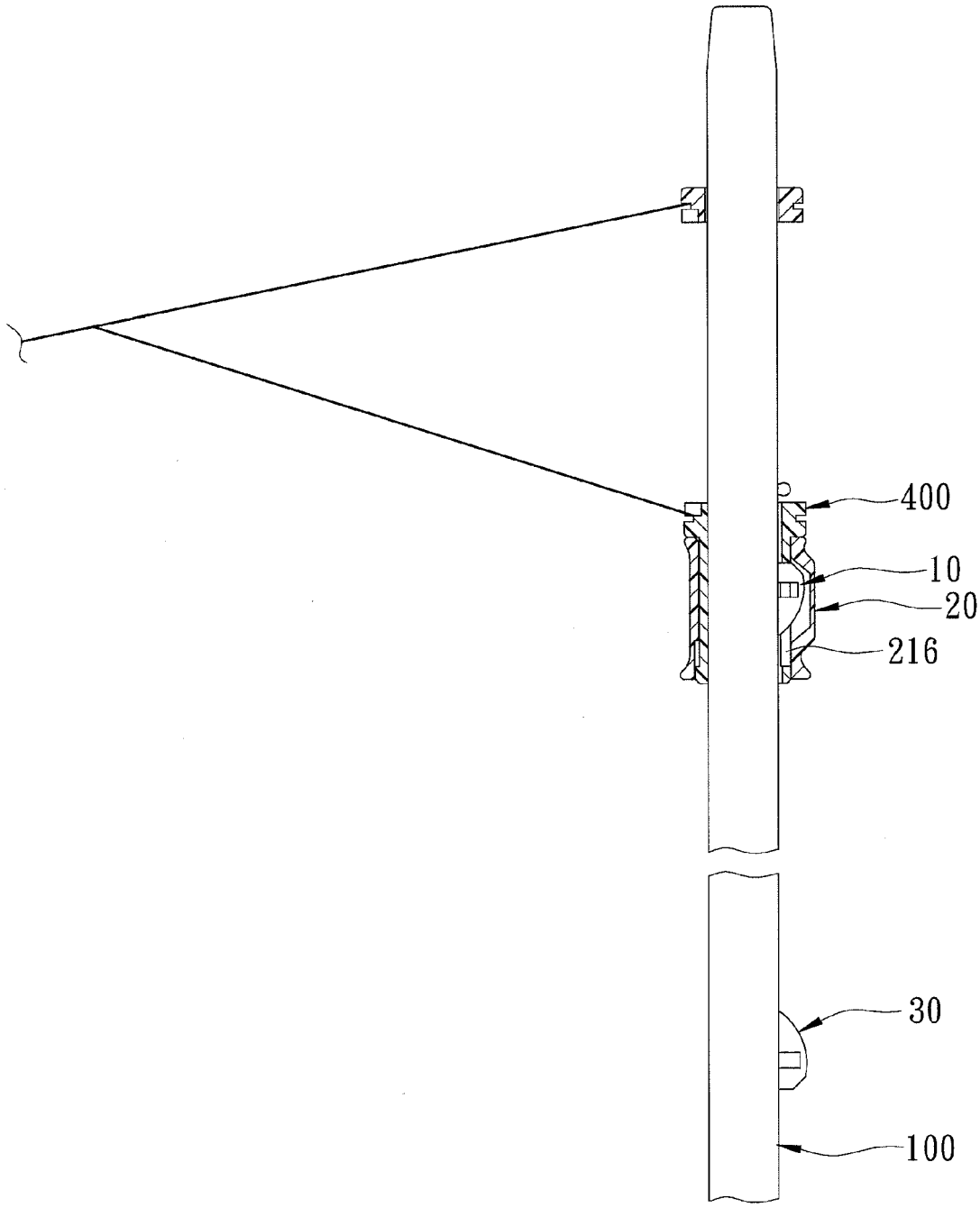
FIG. 7 is a fragmentary sectional view of the second preferred embodiment in an opened state.

As shown in FIG. 6, when it is desired to open the umbrella, the sleeve member 22 is pushed upwardly to move axially away from the lower position. The lower actuated region 36 is pushed against a biasing action to retreat inwardly and radially so as to sweep the lower retaining region 31 away from abutment with the lower abutment wall 218, thereby permitting the lower abutment wall 218 to move away from the lower position by sliding over the lower cammed surface. Subsequently, as shown in FIG. 7, the operating unit 20, as well as the runner 400, is continued on moving upwardly past the upper spring catch 10 to thereby be retained by the upper spring catch 10.

Figure 8:
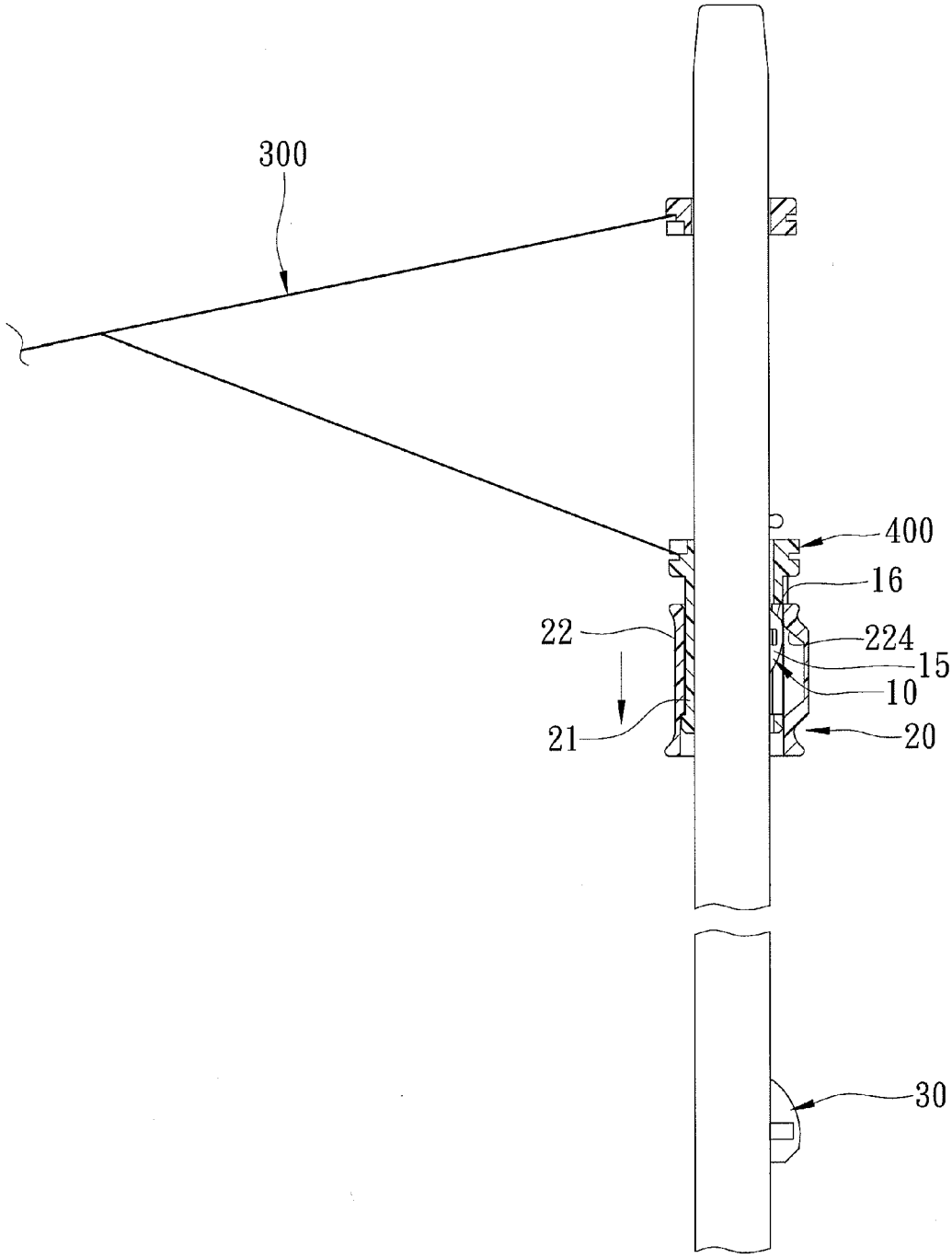
FIG. 8 is a fragmentary sectional view of the second preferred embodiment when the sleeve member is moved away from an upper position.
Figure 9:
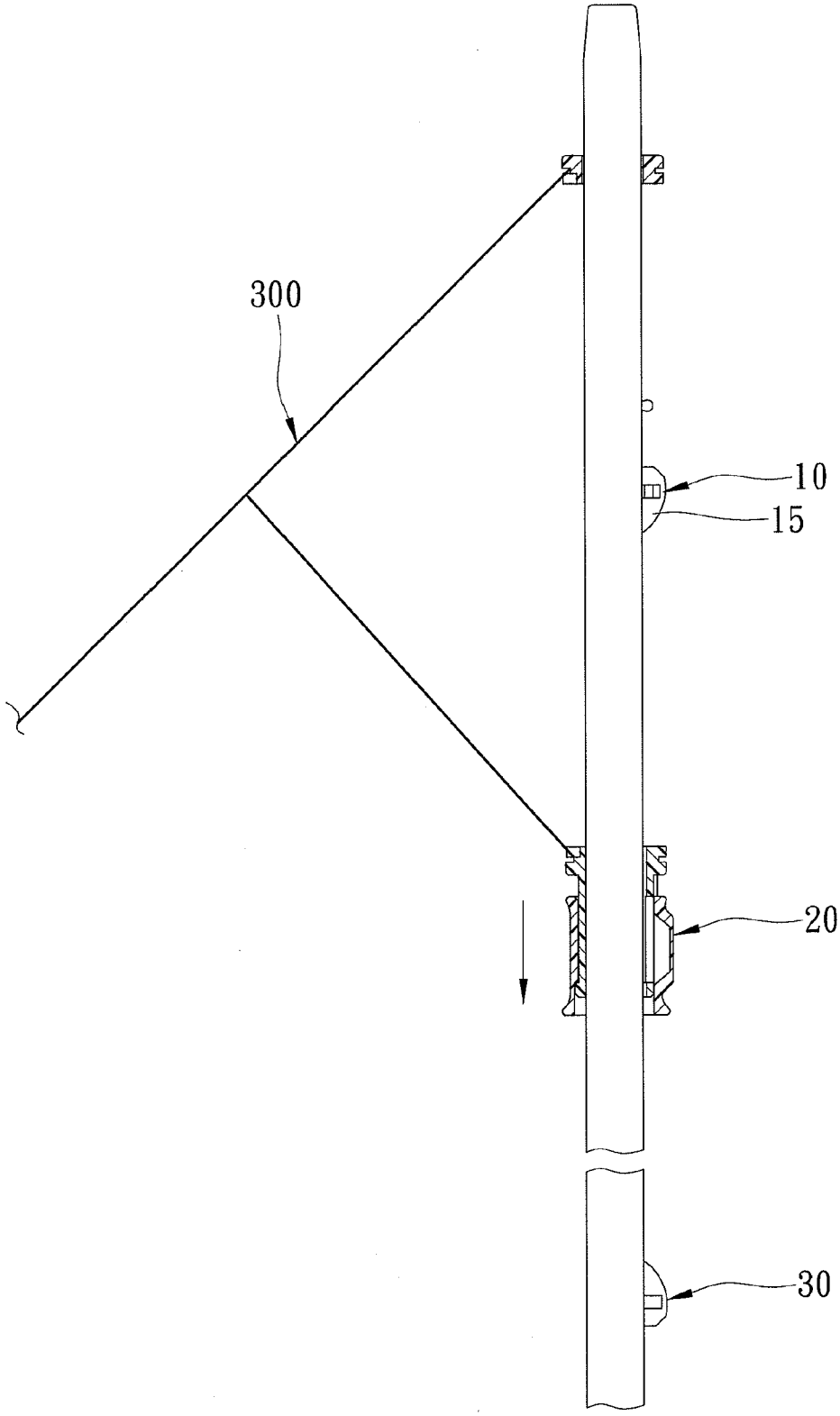
FIG. 9 is a fragmentary sectional view of the second preferred embodiment when the sleeve member is moved toward the lower position.

Referring to FIGS. 8 and 9, when it is desired to collapse the rib- and stretcher assembly 300 for closing the umbrella, the operating unit 20 is pulled downwardly. By mating engagement between the upper camming surface 224 and the upper cammed surface, the catch end 15 is pressed against the biasing action to retreat inwardly to permit sliding movement of the operating unit 20 over the upper spring catch 10. Thereafter, the operating unit 20 is pulled downwardly over and retained by the lower spring catch 30.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A runner fastening device for an umbrella which includes a central shaft unit extending in a direction of an axis to terminate at top-side and bottom-side ends, and defining an upper slot that is disposed proximate to the top-side end and a lower slot that is disposed proximate to the bottom-side end; a rib-and-stretcher assembly pivotally connected to the top-side end for mounting a canopy thereon; and a runner pivotally connected to the rib-and-stretcher assembly and sleeved on and movable relative to said central shaft unit between upper and lower positions for spreading and collapsing the canopy, said runner fastening device comprising:

an upper spring catch having a mount end adapted to be mounted in the upper slot, and a catch end which extends outwardly of the upper slot, and which is biased radially and outwardly, said catch end being configured to have an upper retaining region which confronts upwardly and in the direction of the axis, and an upper actuated region which extends outwardly and radially from said upper retaining region, and which has an upper cammed surface that is inclined outwardly and downwardly from the upper retaining region;

a retained member which is adapted to move with the runner along the axis between the upper and lower positions, and which has a tubular retained wall that extends from the runner along the axis to define an axial space, and that is configured to surround the central shaft unit, said tubular retained wall having a retained slot which extends radially to communicate said axial space, and which extends axially to terminate at an upper abutment wall that is brought to abut against said upper retaining region so as to hold the runner at the upper position;

a sleeve member having an inner sleeve wall which extends along the axis and which surrounds and is axially movable relative to said tubular retained wall between the upper position and the lower position, and which has an upper camming surface configured to mate with said upper cammed surface in the upper position such that, when said sleeve member is moved axially away from the upper position, said upper actuated region is pressed against a biasing action to retreat inwardly and radially so as to sweep said upper retaining region away from abutment with said upper abutment wall, thereby permitting said upper abutment wall to move away from the upper position by sliding over said upper cammed surface; and a lower spring catch having a mount end adapted to be mounted in the central shaft unit adjacent to the bottom-side end, and a catch end which extends outwardly of the lower slot, and which is biased radially and outwardly, said catch end being configured to have a lower retaining region confronting downwardly and in the direction of the axis, and a lower actuated region which extends outwardly and radially from said lower retaining region, and which has a lower cammed surface that is inclined upwardly from the lower retaining region, wherein said retained slot of said tubular retained wall further extends axially to terminate at a lower abutment wall which axially confronts said upper abutment wall, and which is brought to abut against said lower retaining region so as to hold the runner at the lower position, and wherein said inner sleeve wall of said sleeve member further has a lower camming surface which is opposite to said upper camming surface, and which is inclined upwardly to mate with said lower cammed surface in the lower position such that, when said sleeve member is moved axially away from the lower position, said lower actuated region is pressed against a biasing action to retreat inwardly and radially so as to sweep said lower retaining region away from abutment with said lower abutment wall, thereby permitting said lower abutment wall to move away from the lower position by sliding over said lower cammed surface.

2. The runner fastening device according to claim 1, wherein said retained member has a flange extending radially and outwardly from a lower end of said tubular retained wall to cooperatively define a shoulder facing upwardly, said inner sleeve wall of said sleeve member being sleeved on and slidably movable relative to said tubular retained wall, and extending downwardly to terminate at an abutting surface that axially confronts said shoulder so as to abut against said shoulder once said sleeve member is moved away from the upper position, thereby facilitating movement of said retained member toward the lower position while preventing said sleeve member from falling off from said retained member.

3. The runner fastening device according to claim 1, wherein said upper cammed surface is configured to include a first cammed segment which is inclined outwardly and downwardly from said upper retaining region, and said lower cammed surface is configured to include a second cammed segment which is inclined outwardly and upwardly from said lower retaining region.

4. The runner fastening device according to claim 1, wherein said retained member is configured to extend from, and to be integrally formed with the runner.

5. A runner fastening device for an umbrella which includes a central shaft unit extending in a direction of an axis to terminate at top-side and bottom-side ends, and defining an upper slot that is disposed proximate to the top-side end and a lower slot that is disposed proximate to the bottom-side end; a rib-and-stretcher assembly pivotally connected to the top-side end for mounting a canopy thereon; and a runner pivotally connected to the rib-and-stretcher assembly and sleeved on and movable relative to said central shaft unit between upper and lower positions for spreading and collapsing the canopy, said runner fastening device comprising:

an upper spring catch having a mount end adapted to be mounted in the upper slot, and a catch end which extends outwardly of the upper slot, and which is biased radially and outwardly, said catch end being configured to have an upper retaining region which confronts upwardly and in the direction of the axis, and an upper actuated region which extends outwardly and radially from said upper retaining region, and which has an upper cammed surface that is inclined outwardly and downwardly from the upper retaining region;

a retained member which is adapted to move with the runner along the axis between the upper and lower positions, and which has a tubular retained wall that extends from the runner along the axis to define an axial space, and that is configured to surround the central shaft unit, said tubular retained wall having a retained slot which extends radially to communicate said axial space, and which extends axially to terminate at an upper abutment wall that is brought to abut against said upper retaining region so as to hold the runner at the upper position;

a sleeve member having an inner sleeve wall which extends along the axis and which surrounds and is axially movable relative to said tubular retained wall between the upper position and the lower position, and which has an upper camming surface configured to mate with said upper cammed surface in the upper position such that, when said sleeve member is moved axially away from the upper position, said upper actuated region is pressed against a biasing action to retreat inwardly and radially so as to sweep said upper retaining region away from abutment with said upper abutment wall, thereby permitting said upper abutment wall to move away from the upper position by sliding over said upper cammed surface; and a lower spring catch having a mount end adapted to be mounted in the central shaft unit adjacent to the bottom-side end, and a catch end which extends outwardly of the lower slot, and which is biased radially and outwardly, said catch end being configured to have a lower retaining region confronting downwardly and in the direction of the axis, and a lower actuated region which extends outwardly and radially from said lower retaining region, and which has a lower cammed surface that is inclined upwardly from the lower retaining region, wherein said retained slot of said tubular retained wall further extends axially to terminate at a lower abutment wall which axially confronts said upper abutment wall, and which is brought to abut against said lower retaining region so as to hold the runner at the lower position, and wherein said inner sleeve wall of said sleeve member further has a lower camming surface configured to mate with said lower cammed surface in the lower position such that, when said sleeve member is moved axially away from the lower position, said lower actuated region is pressed against a biasing action to retreat inwardly and radially so as to sweep said lower retaining region away from abutment with said lower abutment wall, thereby permitting said lower abutment wall to move away from the lower position by sliding over said lower cammed surface.

* * * * *